US006572206B2

(12) United States Patent
Byrne et al.

(10) Patent No.: US 6,572,206 B2
(45) Date of Patent: Jun. 3, 2003

(54) MULTIPLE POSITION CONTROL PANEL

(75) Inventors: Robert M. Byrne, Lima, OH (US); Kurt F. Hafeken, Sr., Elida, OH (US); Richard J. Pfeifer, Westerville, OH (US)

(73) Assignee: American Trim, LLC, Lima, OH (US)

( * ) Notice: Subject to any disclaimer, the term of this patent is extended or adjusted under 35 U.S.C. 154(b) by 0 days.

(21) Appl. No.: 09/961,504

(22) Filed: Sep. 24, 2001

(65) Prior Publication Data

US 2003/0057811 A1 Mar. 27, 2003

(51) Int. Cl.[7] ..... A47K 1/04
(52) U.S. Cl. ..... 312/228; 312/263; 312/265.6
(58) Field of Search ..... 312/228, 257.1, 312/265.6, 265.5, 263, 279; 248/27.1

(56) References Cited

U.S. PATENT DOCUMENTS 3,763,400 A * 10/1973 Layton et al. ..... 312/108
4,003,613 A * 1/1977 Oakley ..... 312/138.1
4,798,424 A * 1/1989 Coates et al. ..... 248/558
5,375,921 A 12/1994 Tupa et al. ..... 312/257.1
5,971,510 A * 10/1999 Lickiss et al. ..... 312/228
D434,196 S * 11/2000 Schober ..... D32/28

* cited by examiner

*Primary Examiner*—Lanna Mai
*Assistant Examiner*—Jerry A. Anderson
(74) *Attorney, Agent, or Firm*—Rankin, Hill, Porter & Clark LLP

(57) ABSTRACT

An end cap for preliminary attachment of a control panel to a main body of an appliance includes a generally planar body having a front side and first and second supporting sides. The supporting sides are disposed at a rear and bottom of the planar body and are adapted for securement to the appliance main body. Each of the supporting sides has a plurality of securing tabs extending therefrom. The securing tabs are adapted to extend through an opening in the appliance main body and to engage the main body to preliminarily secure the control panel to the main body.

2 Claims, 3 Drawing Sheets

MULTIPLE POSITION CONTROL PANEL

BACKGROUND OF THE INVENTION

1. Field of the Invention

The present invention generally relates to control panels and, more particularly, to control panels end caps that are designed to facilitate mounting the control panel in one of a plurality of orientations relative to a host machine.

2. Description of the Related Art

In order to provide product differentiation while maintaining or reducing costs, it has been proposed to build a commercial appliance control panel that is positionable in one of a pair of orientations. A first orientation has the face of the control panel at a relatively steep slope or orientation relative to the surface of the machine. A second orientation, in which the face is rotated 180°, disposes the face at a relatively less steep angular orientation. Such a structure is illustrated in U.S. Pat. No. 4,798,424.

However, the assemblies known in the art do not include means to temporarily secure the control panel to the main body of the appliance. Accordingly, it has proven difficult for one person to handle the control panel during the assembly process.

Therefore, there exists a need in the art for a method and device for preliminarily securing the control panel to the appliance main body during assembly. Moreover, there exists a need in the art for a preliminary securement device that is operable regardless of the orientation of the multi-position control panel.

SUMMARY OF THE INVENTION

The present invention is directed toward a method and device for preliminarily securing the control panel to the appliance main body during assembly. The present invention is further directed toward a preliminary securement device that is operable regardless of the orientation of the control panel.

In accordance with the present invention, an end cap for preliminary attachment of a control panel to a main body of an appliance includes a generally planar body having a front side and first and second supporting sides. The supporting sides are disposed at a rear and bottom of the body and are adapted for securement to said appliance main body.

In further accordance with the present invention, each of said supporting sides has a plurality of securing tabs extending therefrom. The securing tabs are adapted to extend through an opening in the appliance main body and to engage the main body to preliminarily secure the control panel to the main body.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
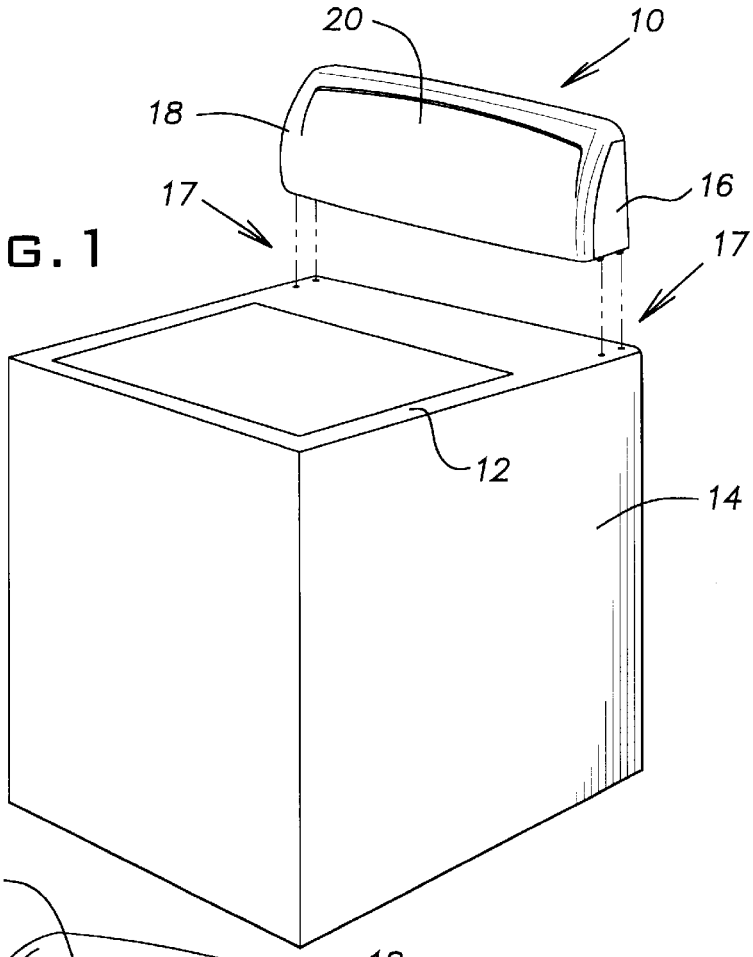
FIG. 1 is an exploded perspective view of an appliance incorporating the present invention with the control panel in a first orientation.

It should be noted that in the detailed description which follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form. It is also noted that although the invention is shown and described herein as it relates to a washing machine, it is contemplated that the preliminary attachment technique taught herein can be used on other appliances.

Figure 2:
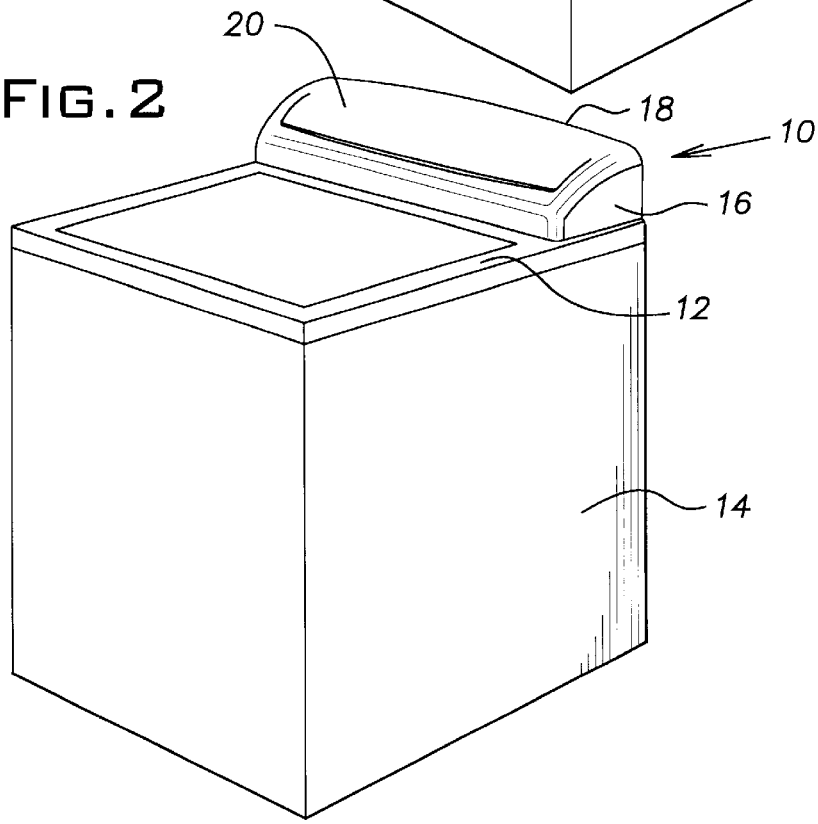
FIG. 2 is a perspective view of the appliance of FIG. 1 with the control panel in a second orientation; and, FIGS. 3–7 are perspective views of different embodiments of the end cap according to the present invention.

With reference to FIG. 1, a control panel 10 is shown spaced from a top surface 12 of a washing machine 14. The washing machine top surface 12 includes mounting openings 17 through which tabs from an end cap 16, to be discussed hereinafter, extend. The control panel 10 is shown in a first orientation wherein it is at a relatively steep angle. The same control panel 10 is in a second orientation in FIG. 2, the second orientation being at a relatively shallow angle.

The control panel 10 includes a body 18 that extends between end caps 16 and is covered by a faceplate 20 . The faceplate 20, includes graphics or writing to assist the user in operating the conventional controls (not shown) mounted thereto. The control panel body 18 and faceplate 20, as well as the general structure and operation of the washing machine 14 are unaffected by the present invention and will not be discussed further hereinafter.

With reference to FIGS. 3–7, the end caps 16 include a front surface 22 and first and second support surfaces 24, 26. The front surface 22 is preferably curved, and includes first and second edges 28, 30. The first edge 28 is located at the intersection of the front surface 22 and the first support surface 24. The second edge 30 is located at the intersection of the front surface 22 and the second support surface 26.

Figure 3:
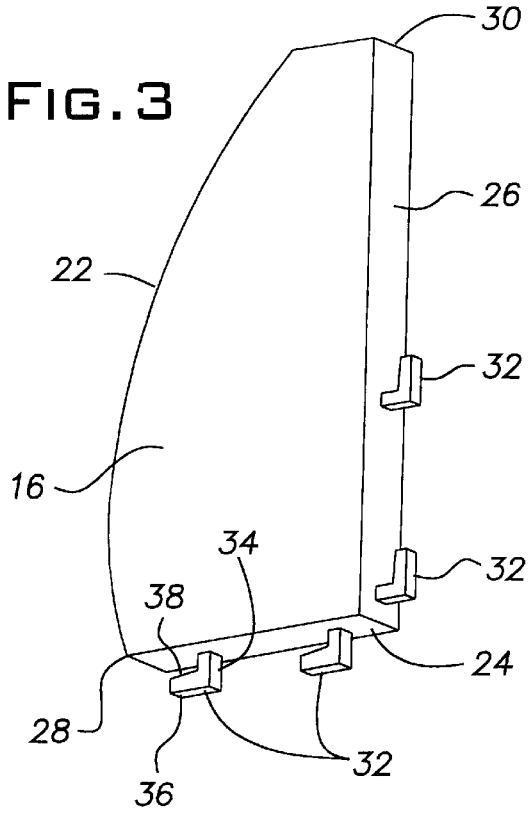
Figure 4:
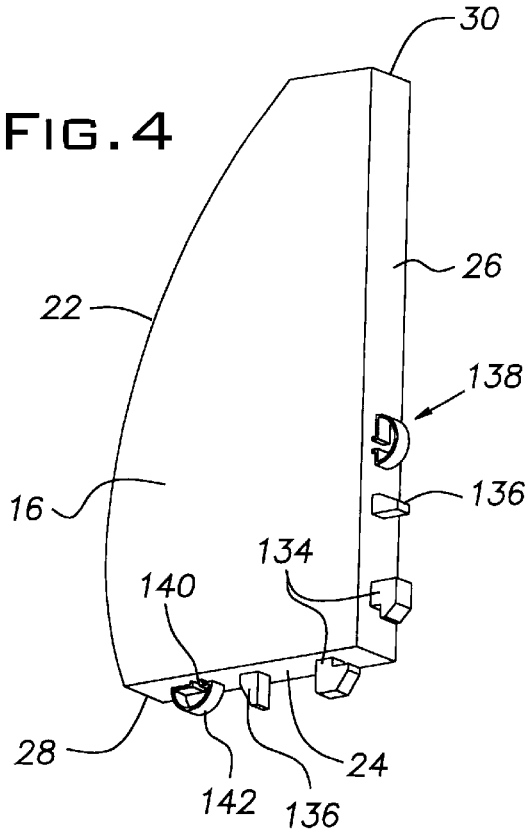
Figure 5:
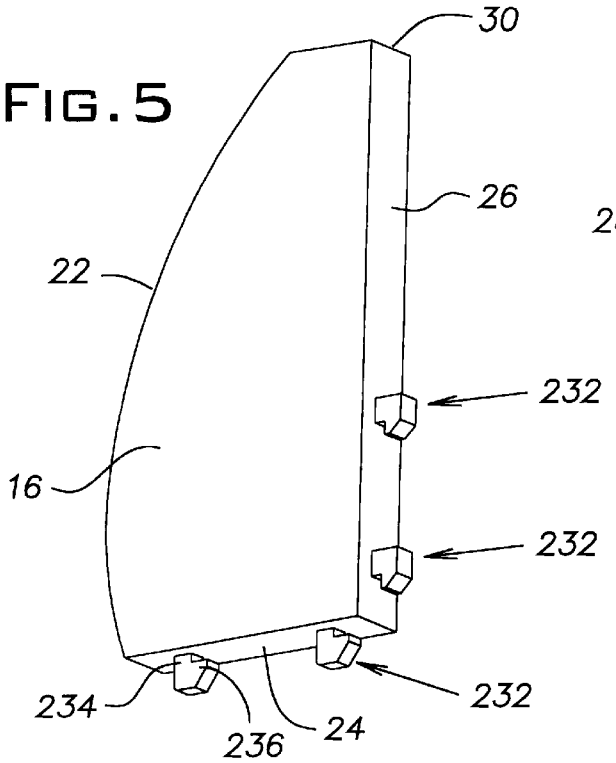

When the control panel 10 is in the first orientation (FIG. 1), the end cap 16 is generally as shown in FIGS. 3–5. In other words, the first support surface 24 is in abutting contact with the top surface 12 of the washing machine 14, and the second support surface 26 is facing rearwardly relative to the washing machine 14 (and may have a rear cover plate secured thereto). The first edge 28 is adjacent the top surface 12 of the washing machine 14, and the second edge 30 is remote from the top surface 12 of the washing machine 14.

Alternatively, when the control panel 10 is rotated such that it is in the second orientation (FIG. 2), the second support surface 26 is in abutting contact with the top surface 12 of the washing machine 14, and the first support surface 24 is facing rearwardly relative to the washing machine 14 (and may have a rear cover plate secured thereto). The second edge 30 is adjacent the top surface 12 of the washing machine 14, and the first edge 28 is remote from the top surface 12 of the washing machine 14.

With reference to the end cap 16 first embodiment shown in FIG. 3, the first support surface 24 and the second support surface 26 each have a pair of L-shaped tabs 32 extending therefrom. The tabs 32 have a first leg 34 that extends generally perpendicular to the associated support surface 24, 26 and a second wedge-shaped leg 36 that extends from the first leg 34. The face 38 of the second leg 36 facing the support surface 24, 26 is angled, and the second leg 36 becomes gradually narrower as it extends away from the first leg 34. Accordingly, the spacing between the second leg 36 and the support surface 24, 26 gradually decreases as one moves from the distal end of the second leg toward the proximal end of the second leg (i.e., toward the first leg).

The end caps 16, and hence the control panel 10, may be preliminarily or temporarily mounted to the washing machine 14 by inserting the second legs 36 of the end cap 16 through the holes 17 in the top surface 12 of the washing machine 14 and then pushing the control panel 10 forwardly to trap the washing machine top surface 12 between the support surface 24, 26 and the second leg face 38. Accordingly, the control panel 10 is secured at each end to the washing machine. Moreover, the control panel 10 is positively positioned and in place for more permanent affixation and assembly.

With reference to FIG. 4, a second preferred embodiment of the end cap 16 is illustrated. The end cap 16 differs from the end cap 16 of FIG. 3 discussed hereinbefore in the structure and arrangement of the tabs 132. The tabs 132 according to the second embodiment include a resilient retainer 134, a locator pin 136, and an L-shaped leg 138. The resilient retainer 134 includes a web 140 that secures the retainer 134 to the associated support surface 24, 26, and a half-moon-shaped member 142 that extends from the web 140. Naturally, in this case the top surface 12 of the washing machine 14 will have three holes 17 to receive the tabs 132 extending from the end caps 16. The end caps 16 are secured by inserting the tabs 134, 136, 138 into the holes 17 in the washing machine top surface 12, and then sliding the end caps 16 rearwardly such that the member 142 and the leg 138 are received under the washing machine top surface 12.

With reference to FIG. 5, a third preferred embodiment of the end cap 16 is shown to include a pair of L-shaped tabs 232. The tabs 232 include a first leg 234 that extends away from the associated support surface 24, 26 and a second leg 236 that extends rearwardly from the first leg 234 and generally parallel to the support surface 24, 26. The end cap 16 is secured by inserting the tabs 232 through the holes 17 provided in the top surface 12 of the washing machine 14 and then pushing the control panel 10 and end caps 16 rearwardly so that a portion of the top surface 12 is received between the support surface 24, 26 and the second leg 235 of the L-shaped tabs.

Figure 6:
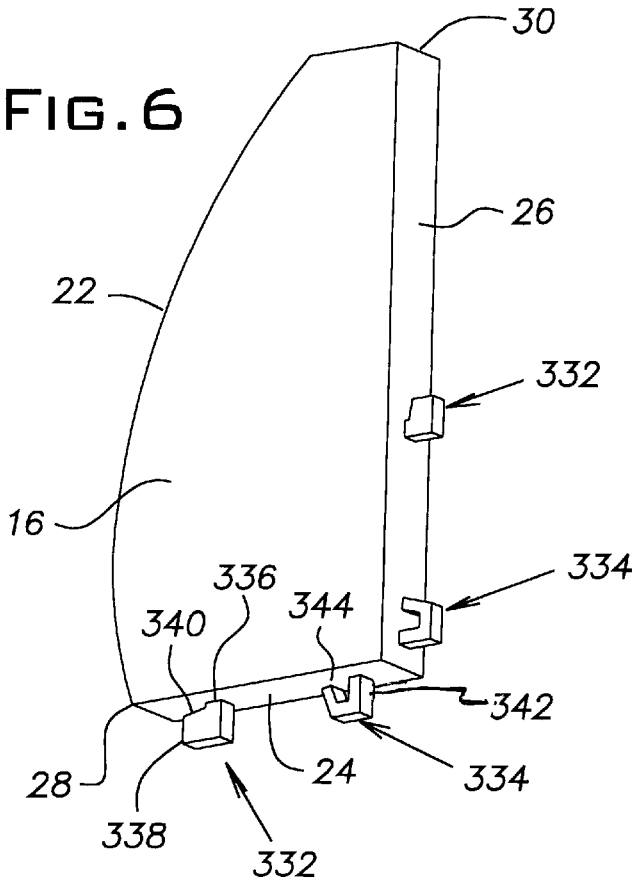

With reference to FIG. 6, a fourth preferred embodiment of the end cap 16 is shown to include an L-shaped tab 332 and a J-shaped tab 334. The L-shaped tab 332 includes a first leg 336 extending away from the associated support surface 24, 26 and a second leg 338 extending forwardly from the first leg 336. A side 340 of the second leg 338 facing the support surface 24, 26 is angled such that the second leg 338 adjacent the first leg 336 is closer to the support surface 24, 26 than the end of the second leg 338 remote or distal from the first leg 336. The J-shaped leg 334 has a proximal end 342 attached to the associated support surface 24, 26 and a distal end 344 spaced from the support surface 24, 26 to define a gap therebetween. The distal end 344 includes a surface facing the support surface 24, 26. The end cap 16 is attached to the washing machine 14 by inserting the tabs 332, 334 through the holes 17 and then moving the control panel 10 and end caps 16 forwardly so that portions of the washing machine top surface 12 are trapped between the support surface 24, 26 and the first tab 332 (i.e., the side 340 of the second leg 338) and between the support surface 24, 26 and the second tab 334 (i.e., the surface of the distal end 344).

Figure 7:
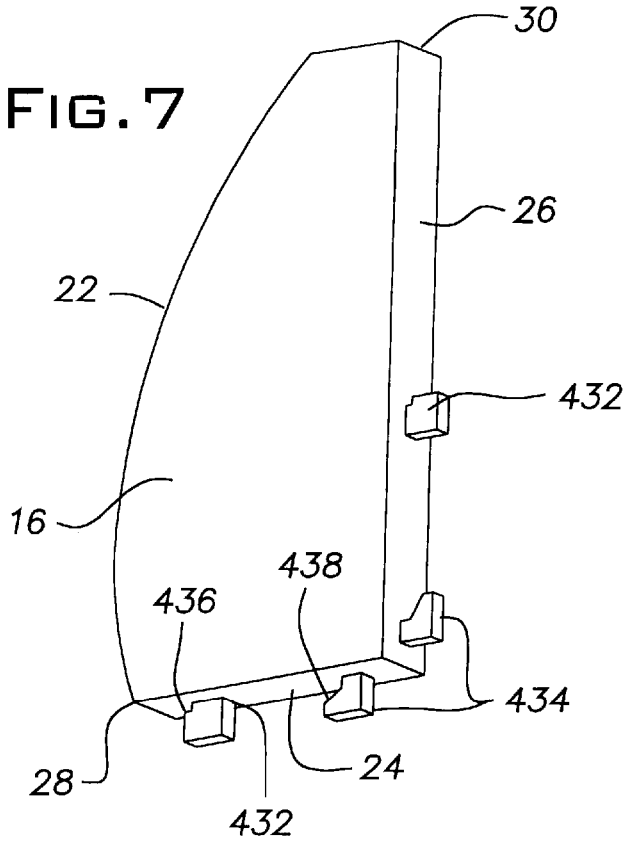

With reference to FIG. 7, a fifth preferred embodiment of the end cap 16 includes a first tab 432 and a second tab 434. The first tab 432 is L-shaped and defines a short ledge-like surface 436 facing the associated support surface 24, 26. The second tab 434 includes a ramping or camming surface 438 facing toward the support surface 24, 26. The end cap 16 of the fifth embodiment is attached to the washing machine 14 by inserting the tabs 432, 434 through the holes 17 in the washing machine top surface 12 and then sliding the control panel 10 and end caps 16 forwardly until the top surface 12 is trapped between the support surface 24, 26 and the ledge-like surface 436 of the first tab.

In each of the preferred embodiments described hereinbefore, for purposes of clarity and completeness, the end cap 16 is shown with tabs permitting it to be secured in either of the two desired orientations. However, only one set of tabs are necessary to hold the control panel 10 to the appliance. Therefore, the end caps will preferably be manufactured with only the tabs that are to be used to hold the control panel 10 to the washing machine. The die used to mold or manufacture the end caps preferably accommodates inserts to selectively block the formation of the non-necessary tabs, as is well known in the plastic injection art. As such, end caps having tabs adapted for either of the desired orientations can be easily manufactured from a single mold, reducing manufacturing costs.

The present invention has been described herein with particularity, but it is noted that the scope of the invention is not limited thereto. Rather, the present invention is considered to be possible of numerous modifications, alterations, and combinations of parts and, therefore, is only defined by the claims appended hereto.

What is claimed is:

1. An end cap for preliminary attachment of a control panel to a main body of an appliance, said end cap being secured to said control panel and including:

a generally planar body having a front side and first and second supporting sides, said supporting sides being disposed at a rear and bottom of the body and being adapted for securement to said appliance main body;

wherein said first and second supporting sides each having securing tabs extending therefrom, said securing tabs being adapted to extend through an opening in said main body and engage said main body to preliminarily secure said control panel to said main body;

wherein said end cap is adapted to be disposed in one of a first position, wherein said first edge is adjacent said appliance main body while said second edge is remote from said appliance body, and a second position, wherein said first edge is remote from said appliance main body while said second edge is adjacent said appliance body, said securing tabs from said first supporting side engaging said main body when said end cap is in said first position and said securing tabs from said second supporting side engaging said main body when said end cap is in said second position.

2. The end cap according to claim 1, wherein said front side is curved and includes a first edge and a second edge, said first edge being defined by the intersection of said front side and said first supporting side while said second edge is defined by the intersection of said front side and said second supporting side.

* * * * *